US009510695B2

(12) United States Patent
Giulietti

(10) Patent No.: US 9,510,695 B2
(45) Date of Patent: Dec. 6, 2016

(54) DISPLAY CHILLER HAVING AUTOMATIC DOORS THAT OPEN TOWARDS THE INTERIOR OF A CABINET

(75) Inventor: Marco Giulietti, Bastia Umbra (IT)

(73) Assignee: INDUSTRIE SCAFFALATURE ARREDAMENTI—ISA S.R.L., Bastia Umbra (PG) (IT)

( * ) Notice: Subject to any disclaimer, the term of this patent is extended or adjusted under 35 U.S.C. 154(b) by 588 days.

(21) Appl. No.: 13/468,076

(22) Filed: May 10, 2012

(65) Prior Publication Data

US 2012/0291471 A1 Nov. 22, 2012

(30) Foreign Application Priority Data

May 19, 2011 (IT) ..... RM2011A0243

(51) Int. Cl.

| | |
|---|---|
| ***A47F 3/04*** | (2006.01) |
| ***E06B 3/36*** | (2006.01) |
| ***F25D 23/02*** | (2006.01) |

(52) U.S. Cl.

CPC ..... *A47F 3/0404* (2013.01); *E06B 3/367* (2013.01); *F25D 23/025* (2013.01); *A47F 3/043* (2013.01); *F25D 23/028* (2013.01); *F25D 2700/04* (2013.01)

(58) Field of Classification Search

CPC ..... A47F 3/0426; A47F 3/043; A47F 3/044; E06B 3/625; E06B 3/362; E06B 3/365; E06B 3/367; E06B 3/48; E06B 3/481; E06B 3/482; F25D 23/02; F25D 23/021; F25D 23/025; F25D 23/028

USPC ..... 62/246, 249; 312/116, 324, 326–329; 49/113, 118, 366, 381, 400, 401; 160/185, 160/186, 199, 200, 205, 206

See application file for complete search history.

(56) References Cited

U.S. PATENT DOCUMENTS

| | | | | |
|---|---|---|---|---|
| 1,396,769 | A * | 11/1921 | Mather | 160/206 |
| 2,247,028 | A * | 6/1941 | Kuntz | 62/261 |
| 3,377,080 | A * | 4/1968 | Bartley et al. | 280/43.23 |
| 3,542,445 | A * | 11/1970 | Donker | 312/116 |
| 3,813,836 | A * | 6/1974 | Dielman | 52/239 |
| 3,860,306 | A * | 1/1975 | Kenyon | 312/116 |
| 4,241,806 | A * | 12/1980 | Metzger | 181/284 |
| 4,341,083 | A * | 7/1982 | Ibrahim et al. | 62/82 |
| 4,393,664 | A * | 7/1983 | Wallace | 62/256 |
| 6,470,952 | B1 * | 10/2002 | Cline et al. | 160/188 |
| 2006/0086050 | A1 * | 4/2006 | Matsuyama et al. | 49/366 |

(Continued)

FOREIGN PATENT DOCUMENTS

| | | | |
|---|---|---|---|
| DE | 100 31 262 A1 | 1/2002 | |
| ES | 2021241 A6 * | 10/1991 | E04H 1/14 |

(Continued)

OTHER PUBLICATIONS

Italian Search Report, dated Dec. 19, 2011, from corresponding Italian application.

*Primary Examiner* — Ryan J Walters
*Assistant Examiner* — Antonio R Febles
(74) *Attorney, Agent, or Firm* — Young & Thompson

(57) ABSTRACT

Described is a display chiller including internally a containment compartment (3) equipped with shelves (7), a front opening (5) for allowing access to the containment compartment (3), and at least a pair of doors (6) hinged about respective axes (X) and openable towards the inside of the containment compartment (3) so as to use the gap (8) existing between the shelves (7) and the doors (6) and designed for the circulation of cooling air.

7 Claims, 5 Drawing Sheets

(56) References Cited

U.S. PATENT DOCUMENTS

| | | | | |
|---|---|---|---|---|
| 2007/0029901 | A1 | 2/2007 | Becke | |
| 2011/0175509 | A1 * | 7/2011 | Moeller | 312/405 |

FOREIGN PATENT DOCUMENTS

| | | | | | |
|---|---|---|---|---|---|
| JP | 09013792 | A * | 1/1997 | E05F 15/10 |
| WO | 03/071207 | A1 | 8/2003 | |

* cited by examiner

DISPLAY CHILLER HAVING AUTOMATIC DOORS THAT OPEN TOWARDS THE INTERIOR OF A CABINET

BACKGROUND OF THE INVENTION

This invention relates to a display chiller such as, for example, a chiller cabinet or a chiller counter of the type used in supermarkets or commercial establishments in general.

More specifically, this invention is applied in the sector of display chillers designed to maintain a low temperature inside by circulating cold air.

Commonly known display chillers are provided with a containment structure equipped with shelves and open at the front for allowing access to the shelves by a consumer for picking up products displayed on the shelves.

In the case of chiller cabinets the containment structure has a mainly vertical extension whilst for the chiller counters the extension of the containment structure is mainly horizontal.

Normally, display chillers are equipped with systems for closing the front opening, openable by the consumer and reclosable to maintain a low ambient temperature inside the chiller. Upon opening, the cold air normally circulating inside the chiller escapes through the front opening dissipating the cooling effect acting on the products housed on the shelves.

Commonly known closing systems provide, for example, one or more transparent sealing doors, openable by rotating outwards by a pulling action exerted by a consumer. These systems require additional space since the doors, in an open configuration, occupy a shape exceeding the shape of the containment structure and this solution is not therefore suitable where it is necessary to install the display chiller in small spaces.

A different solution consists in the use of transparent sliding doors which are located on guides placed side by side in such a way that, when a door is opened, the latter overlaps the other door uncovering part of the front opening of the containment structure. Whilst on the one hand this solution allows a reduction in the overall dimensions, on the other hand it makes it impossible to fully uncover the front opening of the containment structure, since there is always a door partly closing the front. For this reason, the access to the shelves in this solution is always limited to one part of them depending on the door which is moved (this may constitute a limitation where, for example, two consumers attempt to simultaneously access two different products located in different areas of the display chiller: one of the two consumers must wait until the other has finished picking up the products in order to move the relative door).

Another problem associated with these closing systems is linked to the problem of the dispersion of cold air, since sometimes the consumer does not reclose the door after picking up the product, for those systems not equipped with a return spring. In that situation, the cold air present in the chiller no longer remains screened by the door and is dispersed outside. For this reason, there is a costly consumption of energy in order for the cooling circuit to overcome this dispersion, as well as an excessive and unnecessary wear of components.

SUMMARY OF THE INVENTION

In this context, the technical purpose which forms the basis of this invention is to provide a display chiller that overcomes the above-mentioned disadvantages of the prior art.

More specifically, the aim of this invention is to provide a display chiller which can be installed in small spaces.

Another aim of the invention is to provide a display chiller which allows a large and easy access to the entire area occupied by the shelves.

Another aim of the invention is to provide a display chiller which reduces the dispersion of cold air to the outside.

The technical purpose indicated and the aim specified are substantially achieved by a display chiller with the features described in one or more of the appended claims.

BRIEF DESCRIPTION OF THE DRAWINGS

Further features and advantages of the invention are more apparent in the non-limiting description which follows of a preferred non-limiting embodiment of a display chiller illustrated in the accompanying drawings, in which.

DESCRIPTION OF THE PREFERRED EMBODIMENTS

Figure 1:
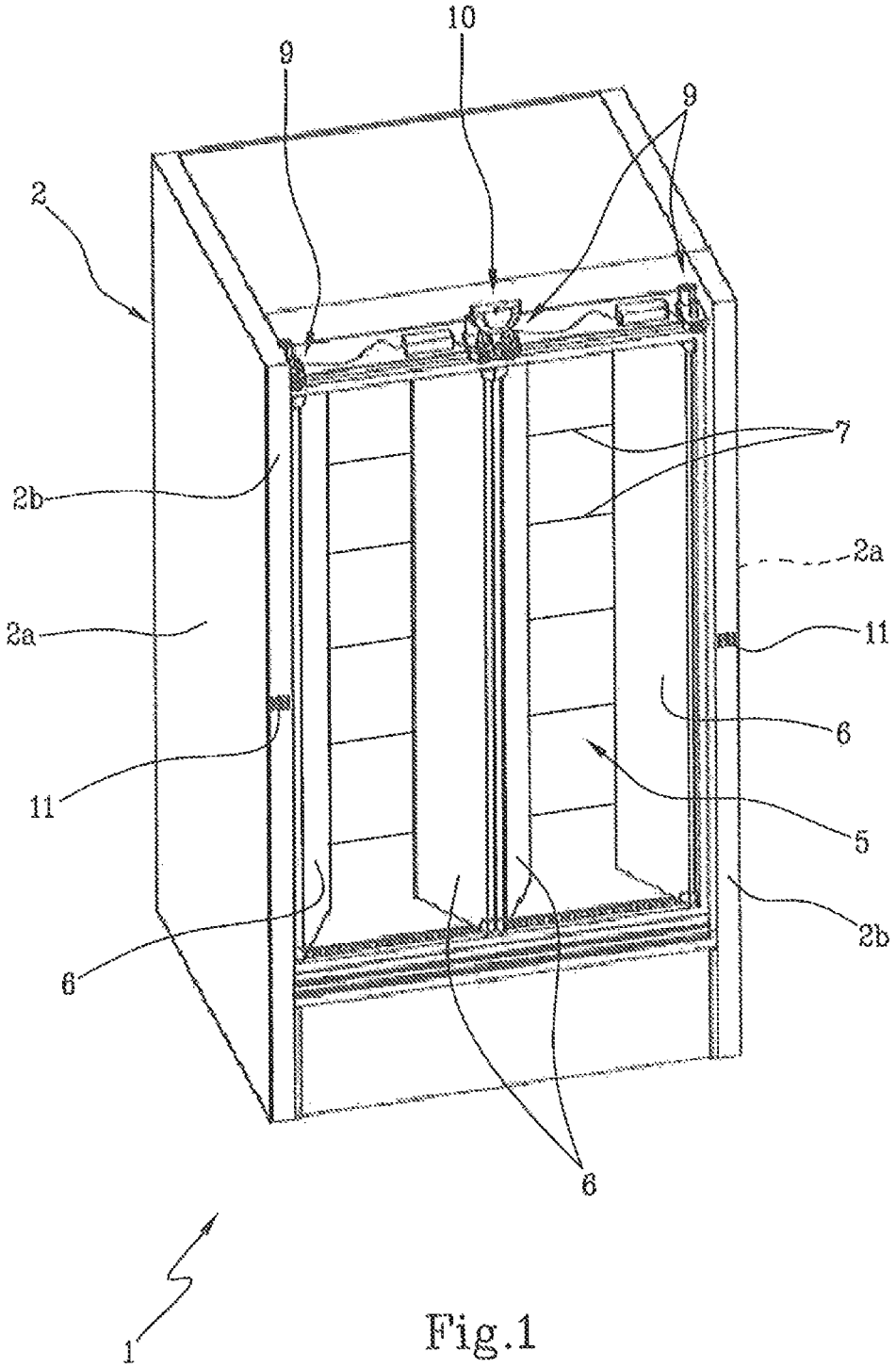
FIG. 1 is a perspective view of a display chiller according to the present invention and in an operating configuration.
Figure 3:
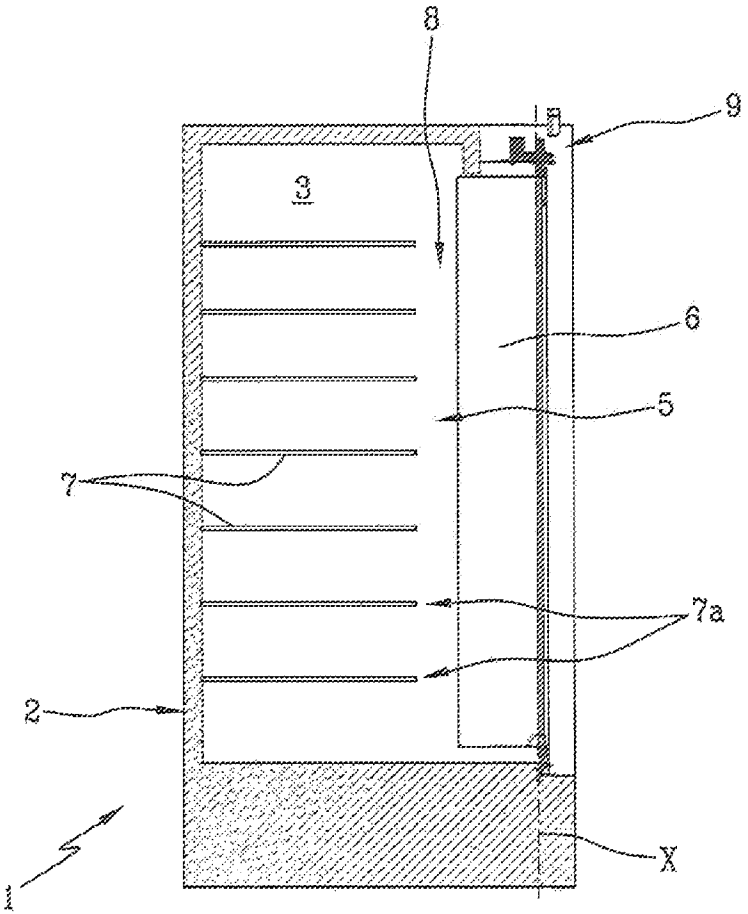
FIG. 3 is a cross-section of the display chiller of FIGS. 1 and 2 according to a vertical section plane along the line III-III of FIG. 2.

With reference to the accompanying drawings, the numeral 1 denotes in its entirety a display chiller according to this invention.

In the context of this invention, the term "display chiller" is used to denote all the types of displays for commercial establishments or supermarkets, equipped with a cooling system and designed for the sale and storage of food and drink. More specifically, the display chiller is designed to display in a visible manner certain products offered for sale and to allow a consumer to directly pick up one or more products to purchase.

More specifically, the above-mentioned term encompasses all the chiller counters (with a mainly horizontal extension) and the chiller cabinets (with a mainly vertical extension).

In the embodiment illustrated in the accompanying drawings, the display chiller 1 is cabinet shaped, thus its extension is mainly vertical.

The chiller 1 comprises an outer containment structure 2 that defines, internally, a containment compartment 3 for a plurality of products, for example dairy products, ice creams, drinks, cooked meats or others.

The containment structure 2 forms a front opening 5 facing the consumer for allowing access to the containment compartment by the consumer. The size of the opening 5 is preferably such as to cover almost entirely the front dimensions of the chiller 1.

The chiller 1 also comprises closing means acting on the front opening 5 for adopting a plurality of configurations between an open configuration, in which access to the containment compartment 3 by at least one consumer is allowed, and a closed configuration designed to maintain the temperature in the containment compartment 3.

More in detail, the closing means comprise at least a pair of doors 6 hinged about the respective hinging axes "X". The two doors 6 of the above-mentioned pair are positioned alongside each other and are hinged at respective opposite edges in such a way as to rotate in opposite directions about the respective hinging axes "X" (FIGS. 4-6).

The doors are at least partly transparent for allowing a customer/consumer to see through them the products positioned inside the containment compartment 3. Preferably, the doors 6 are formed entirely of transparent panels and even more preferably of double glazing.

The chiller 1 is preferably equipped with seals acting between the double glazing and the corresponding ledges of the containment structure for hermetically closing the doors 6.

Figure 4:
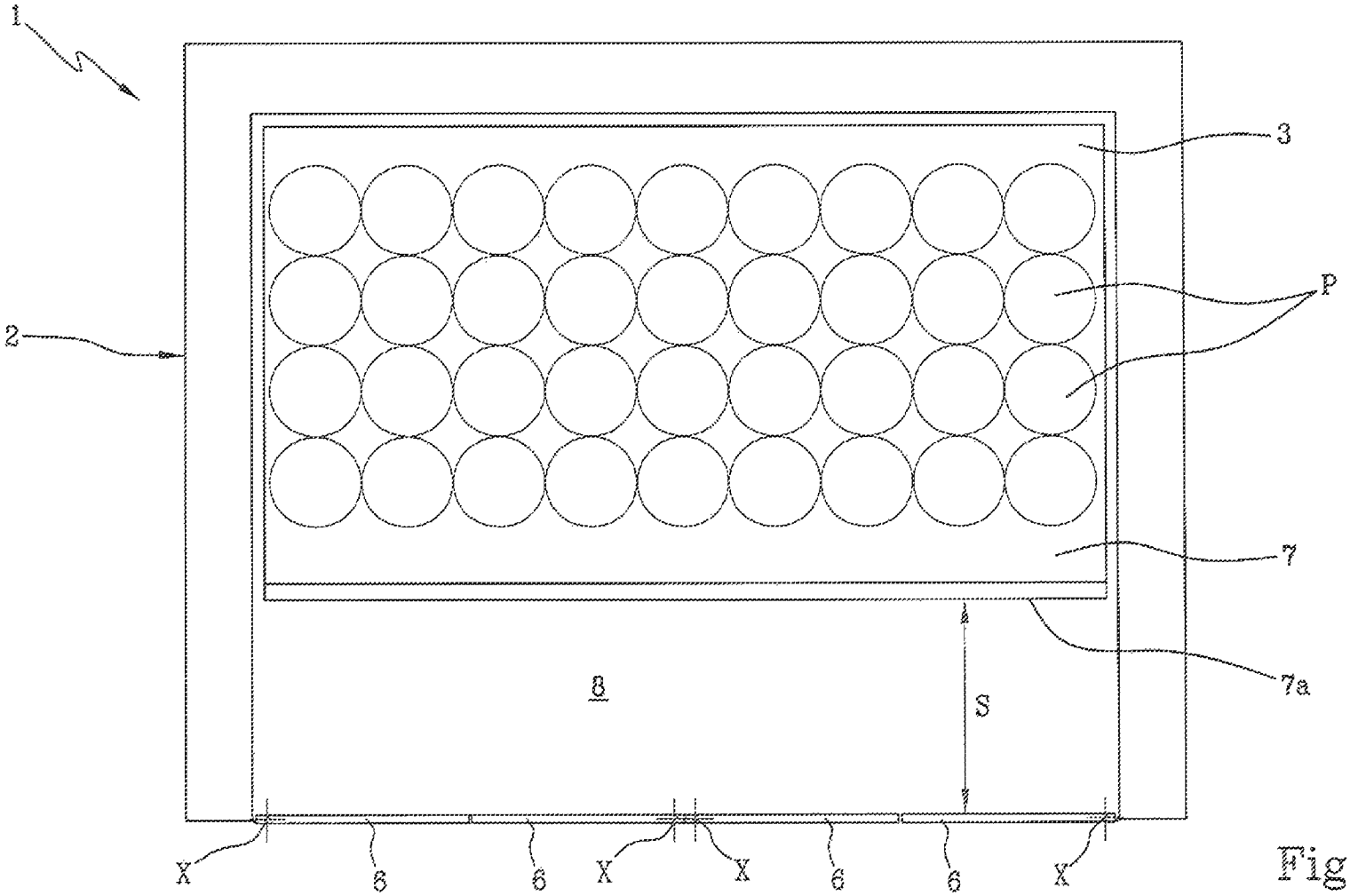
FIGS. 4-6 are three cross-sections of the display chiller of FIGS. 1 and 2 according to a horizontal section plane and in three different operating configurations.
Figure 5:
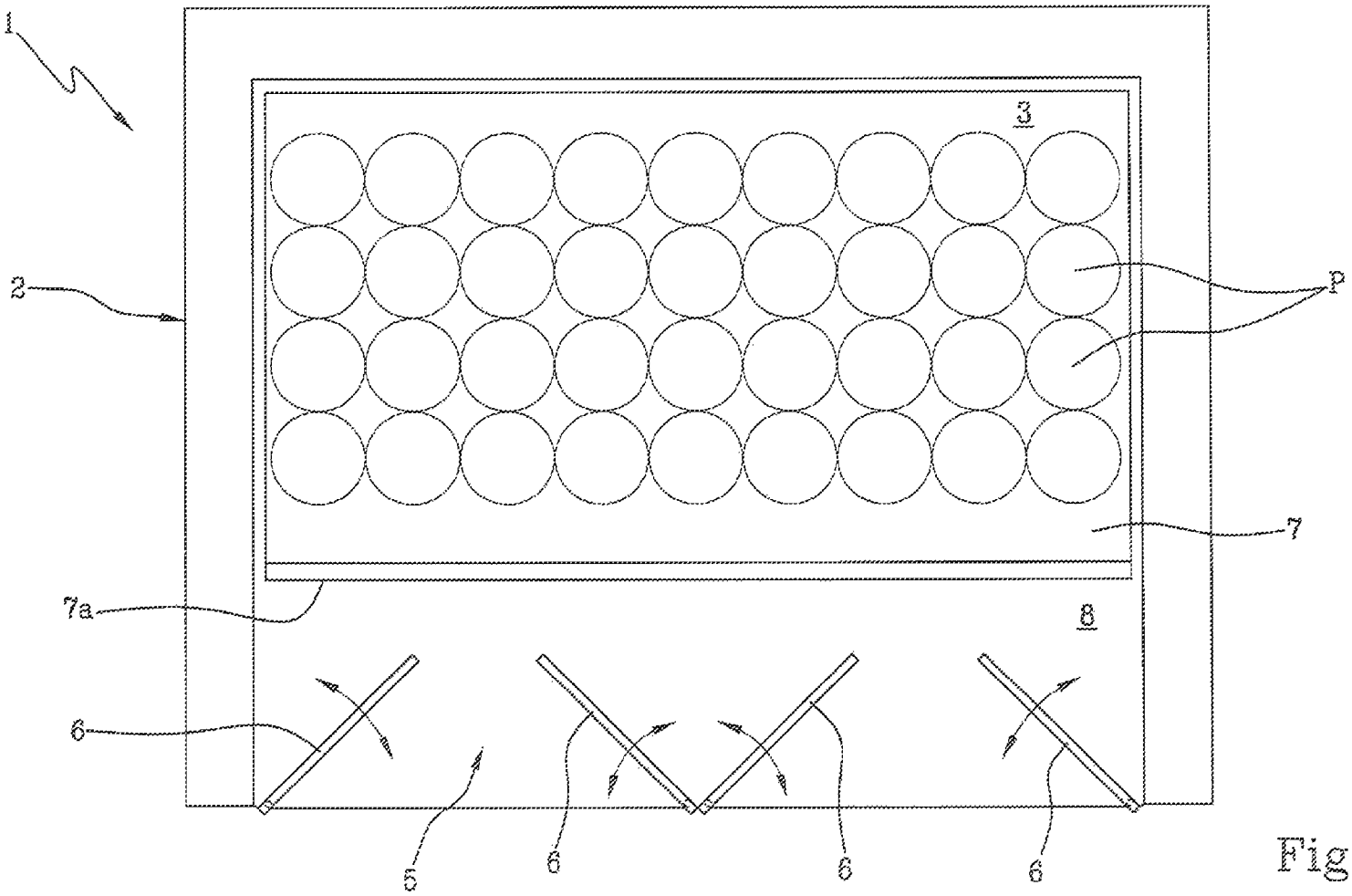
Figure 6:
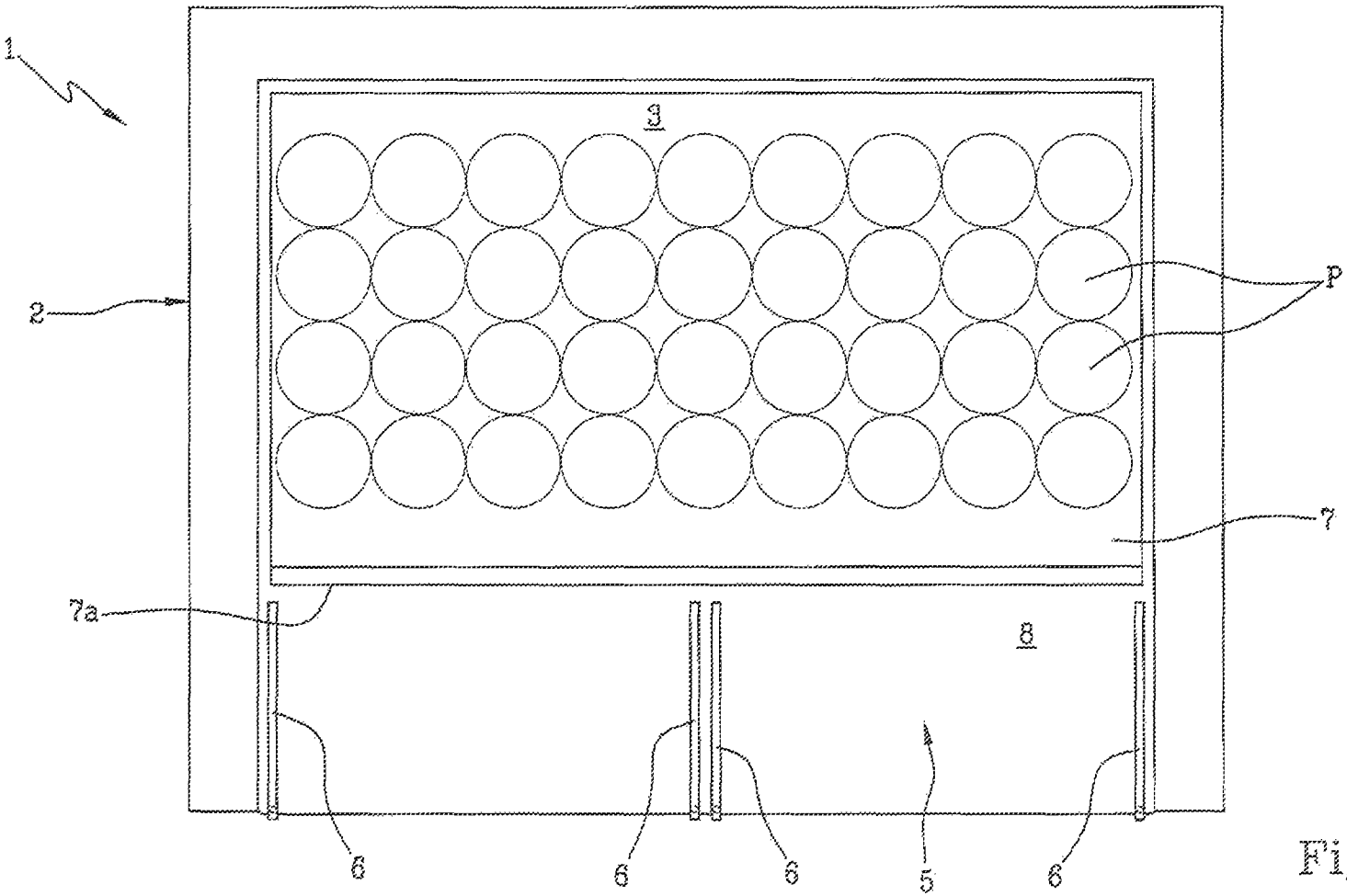

FIGS. 4-6 show three different configurations adopted by the doors 6 (closed configuration in FIG. 4, semi-open configuration in FIG. 5 and completely open configuration in FIG. 6), in which products "P" with a circular cross-section (for example cans or bottles) are displayed.

The containment structure 2 has side walls 2*a* each having a front edge 2*b*. Preferably, the hinging axes "X" of the doors 6 are parallel to the front edges 2*b*.

In the embodiment illustrated in the accompanying drawings, the hinging axes "X" are vertical. In this configuration, the doors 6 are always positioned according to vertical planes.

According to an embodiment not illustrated, the above-mentioned front edges 2*b* are inclined to the vertical, and the hinging axes "X" of the doors 6 are therefore also inclined. In other words, in the latter configuration the hinging axes "X" are determined by the intersection between a plane parallel to the plane in which the side walls 2*a* lie and a plane in which the doors 6 lie when they are in the closed configuration.

More specifically, the plane in which the doors 6 lie in the closed configuration is in this case not vertical but, for example, may be further away from the consumer in the upper part of the containment structure 2. Chillers of this type generally have a shape tapered upwards.

The chiller 1 also comprises means (of the known type and therefore not illustrated) for circulating cold air, designed for cooling the products inside the containment compartment 3.

The chiller 1 also comprises a plurality of shelves 7 positioned inside the containment compartment 3 for supporting products on sale. Each shelf 7 has a front edge 7*a* facing towards the doors 6 and spaced from the doors 6 for forming a gap 8 for the circulation of cooling air.

Advantageously, the doors 6 are openable towards the inside of the containment compartment 3 in such a way that, in the open configuration, the doors 6 are entirely or partly (depending on the distance of the axis of rotation x from the vertical end of the door) facing inside the containment compartment 3.

The size of the gap 8 is such as to allow rotation of the doors 6 by at least 90 degrees from the closed position to the open position without interfering with the shelves 7. More specifically, the gap 8 has a minimum thickness "s" (measured between the front edge 7*a* of the shelves 7 and the plane in which the doors 6 lie in the closed configuration.

In a preferred embodiment of the invention, the chiller 1 also comprises motor-driven means for moving the doors 6 between the open configuration and the closed configuration, and vice versa.

Figure 2:
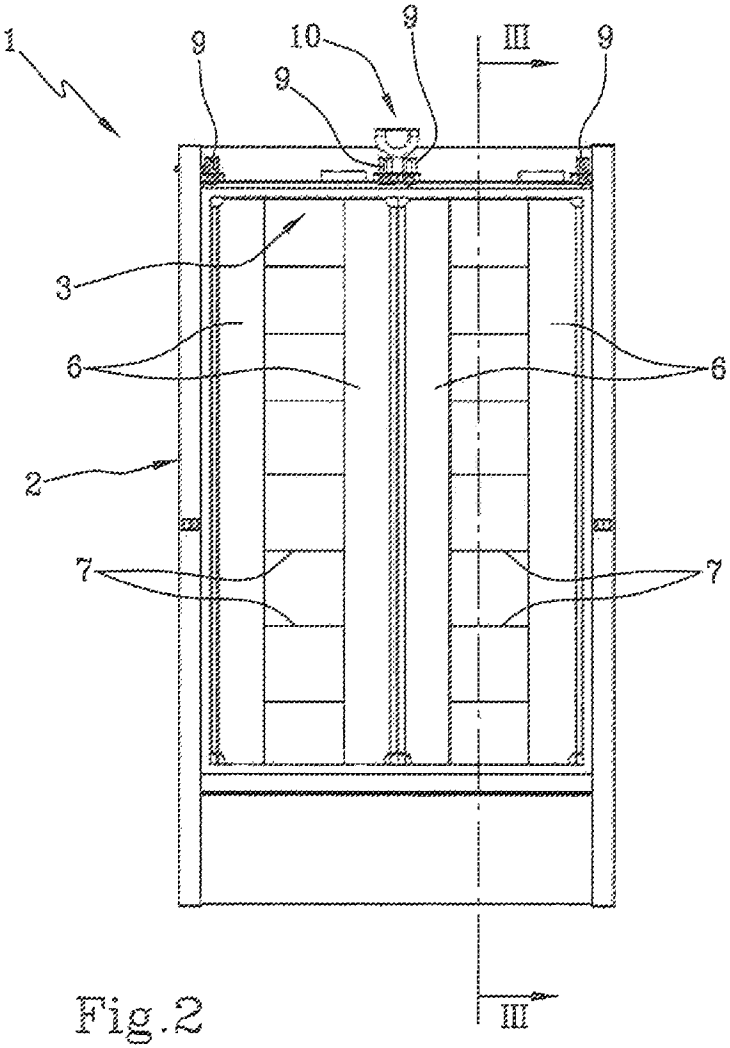
FIG. 2 is a front view of the display chiller of FIG. 1.

As shown in FIGS. 1 and 2, the motor-driven means comprise, for each door 6, an electric motor 9 for moving the respective door 6.

In an embodiment not illustrated, the motor-driven means comprise a single electric motor connected to the doors 6 by transmission systems not illustrated in detail (for example belt and pulley systems).

Advantageously, the chiller 1 comprises means for controlling the opening of the doors 6, associated with the above-mentioned motor-driven means for activating the automatic opening of the doors 6.

The means for controlling the opening of the doors 6 comprise, for example, a photocell 10 (FIGS. 1 and 2) for detecting the presence of a consumer close to the doors 6 and sending, after this detection, an activation signal to the motor-driven means for opening the doors 6.

The photocell 10 is preferably positioned on an upper portion of the containment structure 2, for example on an upper cross-bar.

In addition to the photocell 10 or as an alternative to it, the means for controlling the opening of the doors 6 may comprise one or more opening pushbuttons 11 (FIGS. 1 and 2) which can be operated manually by a customer. The opening pushbutton 11 is preferably positioned on a side upright of the containment structure and/or on the side edge 2*b* of the above-mentioned side wall 2*a*.

In a different embodiment, the means for controlling the opening of the doors 6 comprise a remote control device operated remotely from the chiller 1.

Advantageously, the chiller 1 also comprises means for controlling the closing of the doors 6, associated with the motor-driven means for activating the automatic closing of the doors 6.

In the embodiment illustrated, the means for controlling the closing of the doors 6 comprise the above-mentioned photocell 10 which, the moment the presence of a customer close to the doors 6 is no longer detected, sends an enabling signal to the motor-driven means for closing the doors 6.

In addition to the photocell 10 or as an alternative to it, the means for controlling the closing of the doors 6 may comprise one or more of the above-mentioned opening pushbuttons 11 which can be operated manually by a customer.

In a different embodiment, the means for controlling the closing of the doors 6 comprise a remote control device operated remotely from the chiller 1.

Preferably, the closing means comprise a plurality of pairs of doors 6 (two pairs in the embodiment illustrated). Preferably, each pair of doors 6 may be opened/closed independently from the other pairs for allowing selective access to different zones of the containment compartment 3.

For example, if motor-driven means are used, there is, for each pair of doors 6, a respective pushbutton 11 for opening and/or closing (FIGS. 1 and 2) or, in an embodiment not illustrated, a respective photocell 10.

The features mentioned above with reference to the chiller cabinet are also applicable to other types of display chillers, for example chiller counters, without departing from the inventive concept.

Moreover, other embodiments within the above-mentioned inventive concept are also possible. For example, the doors designed for closing the front opening may have horizontal or inclined hinging axes. In this configuration the same teachings illustrated above still apply with reference to the motor-driven means and the means for controlling the opening/closing of the doors.

This invention achieves the preset aims and overcomes the above mentioned drawbacks of the prior art.

The system of doors described above keeps the containment compartment thermally insulated from the outside environment, thanks to the doors which use double glazing and the closing seals which guarantee the hermetic seal of the system.

The closed position substantially reduces to zero the heat exchange with the outside, such that the chiller behaves, from the point of view of energy consumption, like a chiller cabinet with traditional type doors opening outwards ("glass door cooler").

At the same time, the open configuration with pairs of doors (with a reduced size compared with single doors) facing inwards and engaged in the gap for circulating cooling air reduces the overall dimensions of the chiller allowing installation in small spaces.

Moreover, the adoption of two or more pairs of doors maximizes the accessibility of the product by the customer making the chiller similar to a display chiller of the open type ("open front cooler").

The possibility of opening both pairs of doors independently from the other pairs of doors allows heat dispersion and hence energy consumption to be reduced, also optimizing the accessibility of the products by the customer as all the pairs of doors are potentially openable simultaneously, when required.

This results in an extremely low energy consumption (typical of chiller cabinets or counters closed by doors) and a maximum accessibility (typical of open chiller cabinets or counters).

What is claimed is:

1. A display chiller, comprising:

a containment structure (2) forming internally a compartment (3) for containing products (P) and having a front opening (5) to allow access to the containment compartment (3) by at least one consumer;

a cooling system designed for storage and cooling of food, the cooling system configured to cool an interior of the compartment (3) to define the display chiller for the storage and the cooling of the food;

closing means (6), acting on the front opening (5) between an open configuration, which allow access to the containment compartment (3) by at least one user, and a closed configuration designed to maintain a low temperature in the containment compartment (3), wherein the closing means (6) comprise at least a pair of doors (6) separated from each other and move separately from each other, hinged about the respective axes (X) wherein the axes (X) of the doors are fixed and both of the two doors of the pair of doors, at the same time and independent of each other, are openable away from each other and towards the inside of the containment compartment (3) in such a way that, in the open configuration, the doors are entirely facing inside the containment compartment (3) and are adjacent a respective opposite interior sides of the compartment;

motor-driven means (9) designed to automatically move the doors between the open configuration and the closed configuration, and vice versa, and means (10, 11) for controlling opening of the doors (6), associated with the motor-driven means (9) for activating the automatic opening of the doors (6); and a plurality of shelves (7) positioned inside the containment compartment (3) for supporting products (P) for sale and/or storage, where each shelf (7) has a front edge (7*a*) facing towards the doors (6) and spaced from the doors (6) to form, between the front edge (7*a*) and the doors (6), a gap (8) for the circulation of cooling air, and where the size (s) of the gap (8) is sufficient to allow rotation of the doors (6) towards the inside of the containment compartment (3) of at least 90 degrees from the closed configuration to the open configuration without interfering with the shelves (7), wherein in the closed configuration, adjacent vertical edges of the two doors of the pair of doors are free of connection with each other with the two doors being movable separately away from each other and towards the inside of the containment compartment (3), and wherein the respective axes of the two doors of the pair of doors are located at opposite vertical edges of the two doors adjacent the opening (5) of the compartment (3).

2. A display chiller, comprising:

a thermally insulated outer containment structure (2) forming internally a compartment (3) for containing products (P) and having a front side with a front opening (5) that allows, at least one user, access to an inside of the containment compartment (3);

a cooling system designed for storage and cooling of food, the cooling system configured to cool an interior of the compartment (3) to define the display chiller for the storage and the cooling of the food;

a plurality of pairs of doors positioned alongside each other the pairs of doors positioned side-by-side across the front side of the compartment, wherein all doors of the plural pairs of doors lie on a same plane and access to said compartment, wherein both doors of each pair of doors are separated from each other and move separately from each other, wherein both doors of each pair of doors act on the front opening (5), and are hinged about different respective pairs of fixed axes (X), wherein both doors of each pair of doors are rotatable to open, at the same time and independent of each other, towards the inside of the containment compartment (3) between i) a closed configuration that maintains a temperature in the containment compartment (3), and ii) an open configuration that allows the access to the containment compartment (3), wherein the pair of doors (6) are each hinged at the respective hinging axes (X) and rotate in opposite directions about the respective hinging axes (X) and open towards the inside of the containment compartment (3) in such a way that, in the open configuration the doors entirely face inside the containment compartment (3) and are adjacent a respective opposite interior sides of the compartment or are adjacent a side of another door;

a plurality of shelves (7) positioned inside the containment compartment (3) for supporting products (P), where each shelf (7) has a front edge (7*a*) facing towards the doors (6) and spaced from the doors (6) and form, between the front edge (7*a*) and the doors (6), a gap (8) that allows circulation of cooling air, and where a size of the gap (8) is sufficient to allow rotation of the doors (6) towards the inside of the containment compartment (3) of at least 90 degrees from the closed configuration to the open configuration without interfering with the shelves (7), wherein in the closed configuration, adjacent vertical edges of the two doors of each pair of doors are free of connection with each other with the two doors being movable separately away from each other and towards the inside of the containment compartment (3), and wherein the respective axes of the two doors of each pair of doors are located at opposite vertical edges of the two doors of each pair of doors, with one axis of first door of a first pair of the doors being adjacent one axis of a first door of a second pair of the doors, the first door of the first pair of the doors and the first door of the second pair of the doors opening towards each other and towards the inside of the containment compartment (3);

motor-driven means (9) that automatically move each pair of doors between the open configuration and the closed configuration, and vice versa, said motor-driven means (9) comprising, for each pair of doors (6), a respective electric motor (9) that automatically moves the pair of doors (6) about the respective hinging axis (X); and control means (10, 11) that control automatically opening of each of the pairs of doors (6), the control means (10, 11) being associated with the respective electric motor (9) for activating the automatic opening of each of the pairs of doors (6).

3. The chiller according to claim 2, wherein, the containment structure (2) has side walls (2*a*), each side wall having a front edge (2*b*) and wherein the doors (6) are hinged about the hinging axes (X) parallel to the front edges (2*b*), and the hinging axes (X) are vertical.

4. The chiller according to claim 2, comprising a plurality of said pair of doors (6), each of said pair of doors (6) being openable/closable independently from at least one other of said pair of doors (6) to allow selective access to different zones of the containment compartment (3).

5. The chiller according to claim 2, wherein the doors (6) are at least partly transparent.

6. The chiller according to claim 2, wherein the doors (6) are formed of double glazed glass that, in the closed configuration, seal against the outer containment structure.

7. The chiller according to claim 2, wherein the doors (6) are formed entirely of double glazed glass that, in the closed configuration, seal against the outer containment structure.

* * * * *